US005197744A

United States Patent [19]

Nanau

[11] Patent Number: 5,197,744

[45] Date of Patent: Mar. 30, 1993

[54] SOCCER-AM

[76] Inventor: George Nanau, 87-15 37th Ave., Apt. 4J, Jackson Heights, New York, N.Y. 11372

[21] Appl. No.: 789,007

[22] Filed: Nov. 7, 1991

[51] Int. Cl.[5] ..... A63B 63/00

[52] U.S. Cl. ..... 273/396; 273/411; 273/127 R

[58] Field of Search ..... 273/396, 398, 400, 401, 273/411, 397, 127 R, 127 C

[56] References Cited

U.S. PATENT DOCUMENTS

| | | | |
|---|---|---|---|
| 3,802,703 | 4/1974 | Van Tassel | 273/402 |
| 4,169,598 | 10/1979 | Taylor | 273/400 |
| 4,286,786 | 9/1981 | Papadopoulos | 273/396 |
| 4,478,420 | 10/1984 | Sowards | 273/397 X |

*Primary Examiner*—William H. Grieb

[57] ABSTRACT

Soccer-Am, a version of the game of soccer, provides an additional small soccer goal, installed on top of each of the two soccer goals thus creating an opening space, free of a goal keeper.

This opening space is an open window: an open invitation toward al players in the field of play, to shoot the ball more frequently at the goal for the purpose of higher scoring, and to offer a greater soccer spectacle to the American public. The difference between Soccer-Am and soccer is not only found in terms of "*The Method of Scoring and the Goal*"—but exists in the extended degree of excitement and motivation in the field of play: thus the emphasis is placed on the achievement of entertainment and completition through sport.

1 Claim, 2 Drawing Sheets

SOCCER-AM

BACKGROUND OF THE INVENTION

1. Field of the Invention

The present invention relates, in general, to sport and, in particular, to a new version of the soccer game, named SOCCER-AM. SOCCER-AM means, American Soccer, a combination in latin form, of the words: Soccer and American.

2. Description of the Prior Art

Soccer is proclaimed to be one of the world's most popular sports. Statistics indicate estimated television audience to be in excess of one billion viewers per year. In 1967 a great campaign was launched to make soccer popular in the United States by contracting with famous players from abroad: Brazil, Argentina, Germany, Italy, etc.

General expectations were extremely high. Unfortunately, soccer did not deliver to the American public the anticipated degree of excitement.

One of the reasons can be found in that, soccer players need to be more enthusiastic and require higher motivation in the field of play.

The public is particularly eager to witness higher goal scoring. In practicing the game of soccer, players are trained not only to shoot the ball into the goal, but also to accurately kick the ball into a selected location of the goal opening.

3. Summary of the Invention

The proposed invention relates to a new version of game soccer named SOCCER-AM.

SOCCER-AM has been developed for both entertainment and competition. It is aimed to achieving a greater soccer spectacle by motivating the players to be more enthusiastic in field of play, and having them achieve more frequent goals.

As a game in field of play, SOCCER-AM is the same as soccer. The difference is that SOCCER-AM provides an additional small soccer goal, named "ball rebounder". This unit is installed at the top of each of the two soccer goals, creating an opening space free of a goal-keeper.

The location and size of the two soccer goals is to remain unchanged. The height of this ball rebounder (the additional goal) is 2 feet and 8 inches: ⅓ of the height of the 8 foot soccer goal. The height of each of the two SOCCER-AM goals is 10 feet and 8 inches. An additional 10 inches have to be added to this height, the depth of the two cross-bars (lower and upper). The total height of each of the two identical Soccer-Am goals is 11 feet and 6 inches. The width of the additional goal (ball rebounder) is the same as the width of the soccer goal.

The ball rebounder comprises a cross-bar, two goal posts, a horizontal net support, two parabolic net supports connected to the goal-post, a net connected thereto thus defining a goal space and is made of the same materials, quality and size as for soccer goal. Each of the two parabolic net supports, connected to the goal posts, is connected at the end of the horizontal net support. This structure forms a Ball Rebounder with a net which is tapered inward, toward the horizontal net support, 3 feet in depth.

In field of play, SOCCER-AM applies the same rules and regulations provided by the F.I.F.A. for general soccer games, except, LAW #1(6)-THE GOAL, and LAW #10-THE METHOD OF SCORING.

| | |
|---|---|
| LAW #1(6) | The Goal in Soccer<br>8 yards wide and 8 feet high |
| is replaced by: | |
| LAW #1(6S) | THE GOAL IN SOCCER-AM<br>8 yards wide and 11 feet and 6 inches high |
| LAW #10 | The Method of Scoring in Soccer |
| is replaced by: | |
| LAW #10(S) | THE METHOD OF SCORING IN SOCCER-AM |

Revised Method of Scoring (Law #10(S)

For the soccer goal, three (3) goals are scored when the whole of the ball has passed over the goal-line between the goal-posts and the lower cross-bar, provided that it has not been thrown, carried, or intentionally propelled by hands or arm, by a player of the attacking side, except in the case of a goal-keeper who is in his own penalty-area.

As for the Small Goal (Ball Rebounder) except if otherwise proved by this law, one (1) goal is scored when the whole of the ball has passed the two crossbars (lower and upper) and goal posts, provided that it has not been thrown, carried, or intentionally propelled by hand or arm, by a player of the attacking side, except in the case of a goal-keeper who is in his own penalty-area.

In field of play there are no other changes concerning the rules and regulations that govern the game SOCCER-AM over the game soccer.

DESCRIPTION OF THE PREFERRED EMBODIMENT

Figure 1:
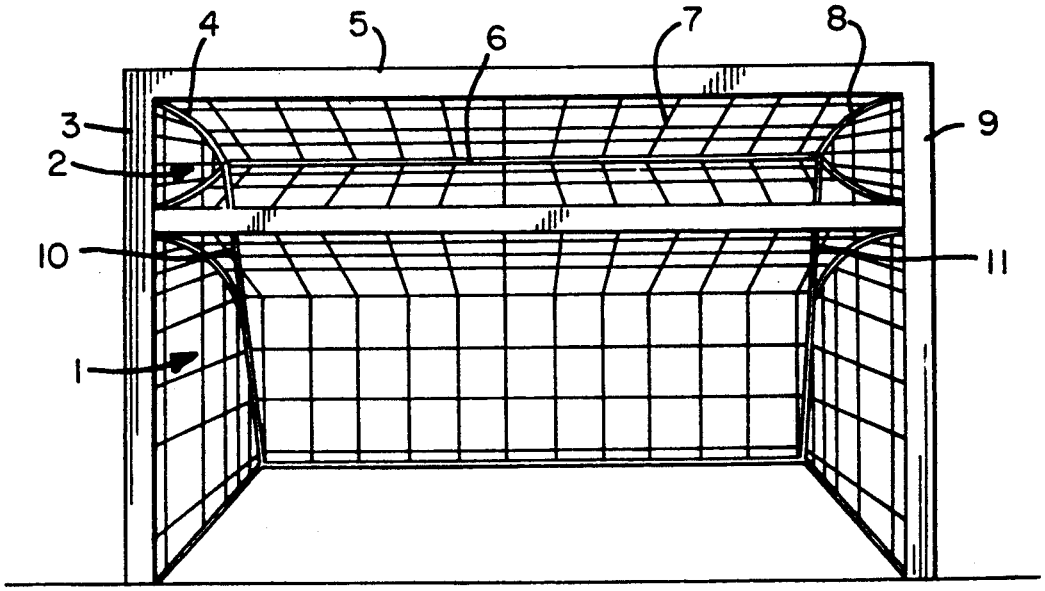
FIG. 1 is a front view of a SOCCER-AM goal embodying the invention.
Figure 2:
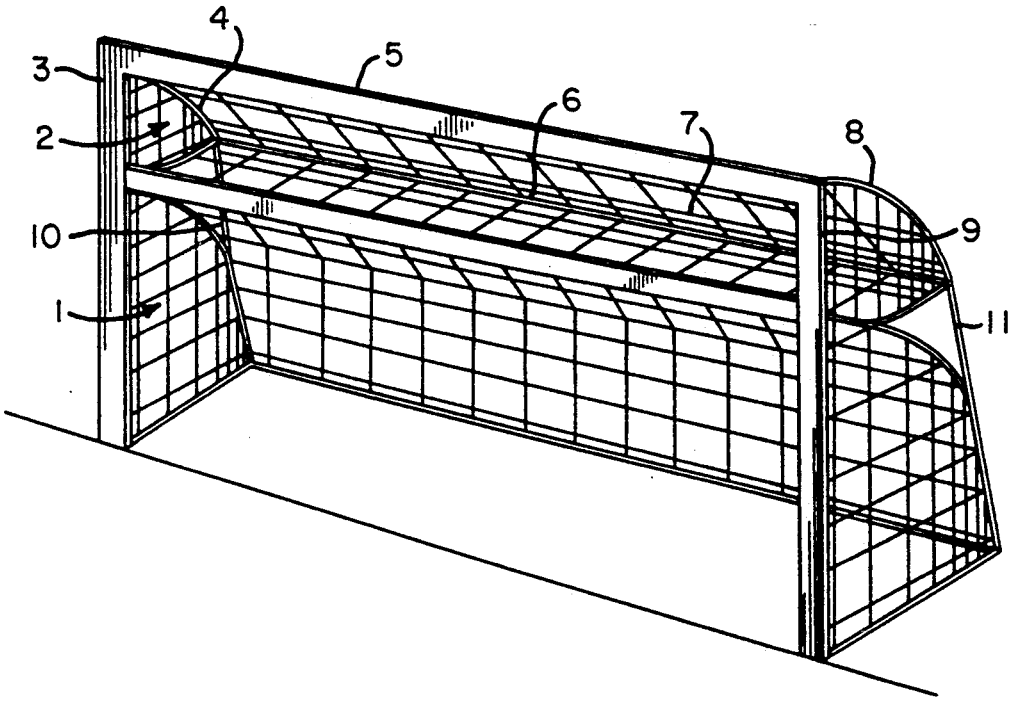
FIG. 2 is a perspective view of a SOCCER-AM goal, shown in FIG. 1.

A SOCCER-AM goal (FIG. 1) embodying the invention comprises an additional soccer goal, acting as "ball rebounder" installed at the top of the original soccer goal (1). The additional soccer goal (2); comprises two goal-posts (3) and (9); a upper cross-bar (5); a horizontal net support (6); two parabolic net supports (4) and (8), a net (7). and two resistant elements (10) and (11) Net (7), connected to the upper and lower crossbars by hooks, relays a horizontal support (6), and two parabolic supports (4) and (8). The two parabolic net supports (4) and (8), connected to goal-posts (3) and (9) (by means of bolts or screws), are connected (welded) at each end of the horizontal support (6).

I claim:

1. An additional soccer goal, installed on top of a regular soccer goal, comprising;

an additional goal frame connected to said regular goal frame above the crossbar of said regular goal frame and defining a second goal space;

a net connected to said additional goal frame to stop and initially retain a soccer ball which enters said second goal space;

said net being tapered toward the crossbar of said regular goal frame to permit a soccer ball which enters said second goal space to roll down toward said crossbar and then fall back upon the field of play.

* * * * *